US006425531B1

(12) United States Patent
Nielsen

(10) Patent No.: US 6,425,531 B1
(45) Date of Patent: Jul. 30, 2002

(54) ATOMIZER FOIL, ATOMIZER HAVING SUCH AN ATOMIZER FOIL AND USE OF SUCH ATOMIZER FOIL

(75) Inventor: Preben Buur Nielsen, Risskov (DK)

(73) Assignees: Cris-ni ApS, Risskov; Søren Anton Kalstrup, Løgstør, both of (DK)

( * ) Notice: Subject to any disclaimer, the term of this patent is extended or adjusted under 35 U.S.C. 154(b) by 0 days.

(21) Appl. No.: 09/581,625

(22) PCT Filed: Oct. 1, 1998

(86) PCT No.: PCT/DK98/00422

§ 371 (c)(1),
(2), (4) Date: Jul. 31, 2000

(87) PCT Pub. No.: WO99/30814

PCT Pub. Date: Jun. 24, 1999

(30) Foreign Application Priority Data

Dec. 16, 1997 (DK) ..... 1467/97

(51) Int. Cl.[7] ..... B05B 9/06; B05B 7/06

(52) U.S. Cl. ..... 239/77; 239/159; 239/432; 239/545; 239/566; 239/DIG. 7

(58) Field of Search ..... 239/159, 77, 548, 239/566, 419, 421, 424, 425, 595, 432, 590, 590.5, 521, 545, 433, DIG. 7, 518

(56) References Cited

U.S. PATENT DOCUMENTS

| | | | | |
|---|---|---|---|---|
| 2,770,501 A | * | 11/1956 | Coanda | 239/545 |
| 2,907,557 A | * | 10/1959 | Coanda | 239/DIG. 7 |
| 3,735,778 A | * | 5/1973 | Garnier | 239/424 X |
| 4,504,014 A | * | 3/1985 | Leuning | 239/433 X |
| 4,509,694 A | | 4/1985 | Inculet et al. | |
| 4,749,129 A | * | 6/1988 | Hanson | 239/77 X |

FOREIGN PATENT DOCUMENTS

| | | |
|---|---|---|
| FR | 2 721 536 | 6/1994 |
| WO | WO8700078 | 1/1987 |
| WO | WO9622155 | 7/1996 |

* cited by examiner

*Primary Examiner*—Steven J. Ganey
(74) *Attorney, Agent, or Firm*—James Creighton Wray; Meera P. Narasimhan

(57) ABSTRACT

An atomizer foil is provided in an atomizer to mix liquid into an air flow passing through the flow duct of the atomizer. In order to achieve an even distribution of liquid drops in the air cone discharged from the atomizer, the liquid is conveyed out on the atomizer foil via outlets disposed symmetrically on the edge of the leading side. Each outlet is connected with an inlet chamber in the atomizer foil via an outlet duct.

14 Claims, 3 Drawing Sheets

ATOMIZER FOIL, ATOMIZER HAVING SUCH AN ATOMIZER FOIL AND USE OF SUCH ATOMIZER FOIL

BACKGROUND OF THE INVENTION

The present invention relates to an atomizer foil for atomizing a liquid in an air flow passing by the atomizer foil as this is located in a flow duct for the air flow, which atomizer foil is approximately shaped as an airfoil with two airfoil broad sides connected at a leading and a rear side edge as seen in the direction of air flow, and an inner duct intended for conveying the liquid and having an outlet at a leading part of the atomizer foil.

The invention also relates to an atomizer containing such an atomizer foil.

Finally, the invention relates to the use of such atomizer foil and/or the atomizer.

Atomizers of the kind mentioned in the introduction are known. An example of such an atomizer is known, for example, from the description to WO 87/00078. Even though an atomizer of this kind has shown an improvement in relation to previously known atomizers, it has appeared in practise that they give an uneven distribution of the liquid in the air flow. In practical tests it has thus shown that by using the atomizer, for example for dosing pesticides or herbicides, an uneven distribution of the liquid in the sprayed area has occurred. Thus there may occur overdosing in certain areas while other areas are underdosed with the desired liquid.

The atomizer foil will preferably be used in an atomizer mounted on a spraying boom together with a row of corresponding atomizers. The spray boom may be used for a field sprayer or the like. The sprayer may be suspended, towed, self-propelled, or a hand-held sprayer.

The sprayer may be placed in a sprayer housing which is a separate part of a spray boom, or which is an integral part of an spray boom.

The mixed flow media, air and liquid, will leave the atomizer in an approximately cone-shaped cloud. It is the distribution of the liquid in this "air cone" which has appeared to be more uneven in the known constructions. Thus, it has appeared that the liquid drops do not occur with an even distribution or a normal distribution under the atomizer or with a high coefficient of variation.

SUMMARY OF THE INVENTION

It is the object of the present invention to indicate an atomizer and an atomizing foil that may give a usable distribution, either in the form of an even distribution or a normal distribution with limited coefficient of variation of the liquid under the atomizer.

This is achieved according to the present invention with an atomizer foil which is peculiar in that the inner duct comprises an inlet chamber connected with one or more outlet ducts, each extending in the longitudinal direction of the atomizer foil and having outlet on the leading side edge so that the outlet is disposed symmetrically in relation to a median plane through the width of the atomizer foil, and that the two airfoil broad sides are disposed symmetrically about said median plane.

The atomizer which makes possible the fulfilment of this purpose is according to the invention peculiar in that the used atomizer foil is provided as defined above and that the flow duct has an uniform section over a central part of its length.

The two flow media, air and liquid, are carried into an atomizer housing containing the atomizer foil. The air is guided through the flow duct of the atomizer housing, the duct may be rectangular or circular and passing the atomizer foil. The liquid is conveyed into the flow duct via the inner channel in the atomizer foil. The inner channel has an outlet at the leading part of the atomizer foil. In the present application, by the leading part of the atomizer foil there is meant that part of the atomizer foil facing the air flow passing through the flow channel. The liquid will thus be pressed/pumped out on the upper side of the two airfoil broad sides of the atomizer foil and will leave the atomizer foil at the rear part thereof. The liquid leaves the atomizer foil as small drops or atomized depending on the speed of the air flow.

By having a uniform flow duct and by arranging the atomizer foil with an inlet chamber connected to the outlet ducts having outlets on the leading side edge, it becomes possible to discharge liquid on the atomizer foil in a direction in parallel with the air flow through the flow duct. As the outlet ducts are disposed symmetrically in relation the median plane through the width of the atomizer foil, the same amount of liquid will be distributed on the two airfoil broad sides. By arranging the outlet symmetrically in relation to the length of the leading side edge, one may achieve an evenly distributed or normally distributed spreading of the liquid under the atomizer. This may be achieved irrespective of there is supplied a greater or lesser amount of liquid.

It is possible to use one or more outlet ducts. In practice, it is possible to use between 2 and 5 and preferably between 2 and 3 outlet ducts each having an opening disposed symmetrically in relation to the length of the leading side edge of the atomizer foil. That means the side edge facing the air flow.

The atomizer foil is disposed in the flow duct in parallel with the direction of the air flow which causes that an even air flow occurs over the two airfoil broad sides. Because of the uniform section of the flow duct, a uniform gripping force will occur along the width of the atomizer foil.

Practical tests have shown that there is achieved a well defined distribution of liquid with an atomizer foil that is designed in accordance with the invention.

It is possible to form the inlet chamber and the outlet ducts in different ways. The inlet chamber may have any angular, curved, or circular section. It is important that the outlet ducts extending from the inlet chamber extend perpendicularly to the inlet chamber and have a smaller sectional dimension than the inlet chamber. Hereby all of the inlet chamber will be filled with liquid and the liquid will be forced out through the outlet in a direction in parallel with the air flow. This forcing out of the liquid will be evenly distributed over all the outlet ducts if the outlet ducts have a smaller section than the inlet chamber. Hereby it is avoided that a larger amount of liquid will flow out of the outlet duct being closest to the inlet opening of the inlet chamber, the inlet opening usually being placed in one of the side walls of the atomizer foil.

Even though different dimensions and shapes are possible, it is preferred to utilise circular outlet ducts and inlet chambers for manufacturing reasons. The diameter of each outlet duct is preferably less than ¾ of the diameter of the inlet chamber and will especially be lesser than half of said diameter. Furthermore, the outlet duct will have a length that at least correspond to the diameter of the inlet chamber and that the length of the outlet duct preferably will be at least two times the said diameter.

The two airfoil broad sides of the atomizer foil may curve over their width. However, it is advantageous that the airfoil broad sides have a rectilinear extension over all their width with an arbitrary point along the length of the airfoil broad sides. In other words, this means that there will be a uniform section over all the width of the atomizer foil. Hereby, there is achieved a uniform distribution of liquid over all the width of the atomizer foil and thereby a well-defined even distribution of the liquid under the atomizer.

In order to achieve a symmetrical flow condition and thereby an even and usable distribution of liquid, it is preferred that the leading and rear side edge of the atomizer foil extend in parallel and perpendicularly to the longitudinal direction of the atomizer foil. This means at the same time that the leading and the rear side edge extend perpendicularly to the air flow through the flow duct.

Furthermore, it is preferred that the rear side edge is a plane surface extending perpendicularly to the media plane through the atomizer foil. It has shown that such a plane surface gives a better distribution than a sharp edged side edge. Alternatively, it will also be possible to have a lesser rounding of the corners at the rear side edge.

The leading side edge of the atomizer foil will have a rounded shape corresponding to that which is known from wings of airplanes and thus also as it is seen from the accompanying drawing.

Alternatively, the leading side edge may be pointed as it also appears from the accompanying drawing.

However, it is important how the rear side edge of the atomizer foil is finished. The plane surface may be established directly in connection to the broad sides. However, there may also be formed a stepwise reduction so that a sectional reduction occurs at the rear part in connection with the rear side edge. Surprisingly it appears that a stepwise reduction from the broad sides with a flat rear side edge on the stepwise reduced part gives a very even distribution of drops in the formed cloud.

Furthermore, it appears to be important to make the atomizer foil with a marked curvature as compared to a more slender shape. In flow ducts with a rectangular section, the thickest part of the atomizer foil should be made so that it fills out much of the width in the flow duct of the atomizer housing. Thus it is preferred that the atomizer foil fills up at least half of the width of the atomizer duct at the point where the atomizer foil has its greatest thickness.

It has also appeared to be advantageous to use the atomizer foil with an orientation which is different than previously. Until now it has been assumed that the atomizer foil is placed in a boom with an orientation transverse to the direction of movement. However, surprisingly it has appeared to be advantageous if the atomizer foil is orientated in parallel with the direction of movement.

However, in this situation it is important to ensure the exact orientation of the atomizer foil with a median plane of the atomizer foil in parallel with a plane for a longitudinal section through the atomizer housing. This may be achieved by providing the longitudinal edges of the atomizer foil with guide means co-operating with guide grooves which are located in the wall of the flow duct. Hereby, there is achieved a secure control of the orientation of the atomizer foil and thereby a uniform spreading of the cloud being discharged from the atomizer.

By orientating the atomizer foil in parallel with the direction of driving, it has appeared to be possible to produce a cloud where the outermost part of the cloud may be brought to overlap a cloud formed by an adjacent atomizer. This is advantageous as one may hereby compensate for the reduced amount of drops which will be in peripheral area of the so-called douche area covered by the cloud from an atomizer.

The atomizer foil may be produced in different ways and of different materials depending on the intended use. However, it is suitable to make the atomizer foil by injection moulding of plastic.

An atomizer foil according to the invention will, because of a very even distribution of liquid gripped in the air flow, be suitable for use in an atomizer for dosing herbicides, pesticides or fertilisers. Alternatively, it will also be possible to use the atomizer foil in an atomizer used for dosing liquid nutrients.

BRIEF DESCRIPTION OF THE DRAWINGS

The invention will be explained more closely hereafter with reference to the accompanying drawing where.

DETAILED DESCRIPTION

In the different Figures, the different elements are shown in different scales for the sake of the amount of details in the individual figures.

Figure 1:
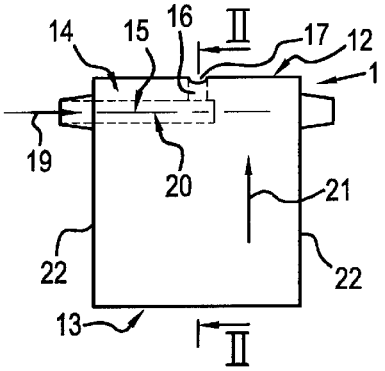
FIGS. 1–4 illustrate a first embodiment of an atomizer foil according to the invention.
Figure 2:
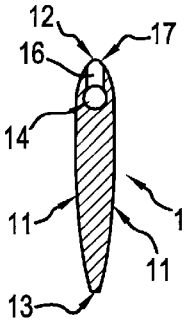
Figure 3:
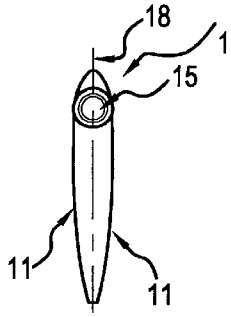
Figure 4:
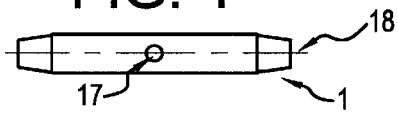
Figure 8:
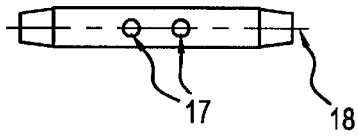
Figure 6:
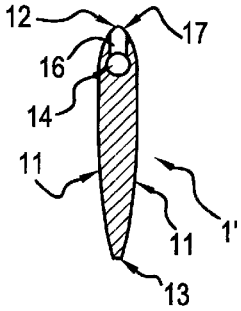
Figure 7:
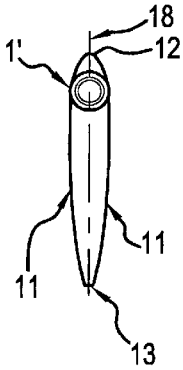

FIG. 1 shows a side view of the first embodiment of an atomizer foil 1, FIG. 2 shows a section according to the arrows II—II in FIG. 1, FIG. 3 shows a side view of the atomizer foil, and FIG. 4 shows a view of the atomizer foil as seen from the front.

The FIGS. 5–8 are views corresponding respectively to FIGS. 1–4, and showing a second embodiment of an atomizer foil 1' according to the invention.

Figure 9:
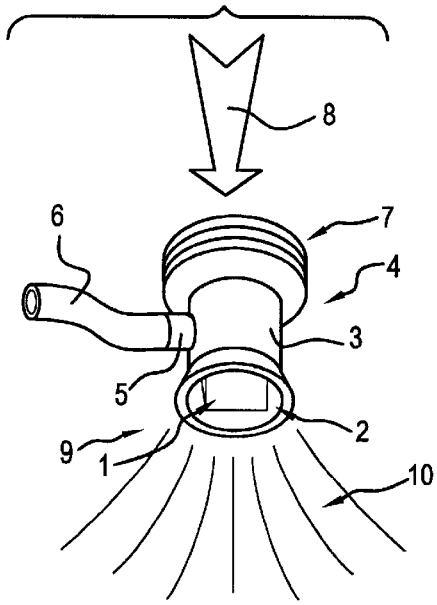
FIG. 9 shows a schematic view of an atomizer according to the invention.

FIG. 9 shows a perspective view of an atomizer containing an atomizer foil according to the invention.

In the following there is given an explanation of the atomizer foils and the atomizer. As corresponding or identical parts are indicated with the same reference numerals, there will not be given any specific explanation in connection with each Figure.

In FIG. 1 there is seen an atomizer foil 1. As it appears from FIG. 9, the atomizer foil 1 is intended to be located in a flow duct 2 in an atomizer housing 3 constituting a part of an atomizer 4. The atomizer housing 3 has an inlet 5 which via a duct 6 is connected with a liquid source being under pressure to carry liquid to the atomizer foil as it is explained later. The atomizer foil 1 is placed in mounting grooves 27 formed in the side walls of the flow duct.

The flow duct 2 is a hollow circular duct which at its upper end 7 is connected with a source sending an air flow 8 through the duct past the atomizer foil 1, so that out from the bottom 9 of the channel there comes a fog 10 or air cone containing gripped air drops which may be more or less atomized.

The atomizer foil 1 is approximately shaped as an airfoil and has two airfoil broad sides 11, these are connected mutually via a leading side edge 12 and a rear side edge 13 and via longitudinal edges 22 extending between the side edges 11, and which preferably are parallel. With leading and rear there is referred to the direction of the air flow 8 past the atomizer foil 1.

The atomizer foil 1 comprises furthermore an inner duct 14 which is connected with the inlet 5 and which is intended to introduce liquid in the atomizer foil. This duct comprises an inlet chamber 15 which is connected with an outlet duct 16 which via an outlet 17 discharges on the leading side edge 12 with a symmetrical location in relation to a median plane 18 through the width of the atomizer foil.

The embodiment shown in FIGS. 5–8 differs from the embodiment shown in FIGS. 1–4 by the atomizer foil 1' in FIGS. 5–8 being provided with two outlet ducts 16.

Figure 5:
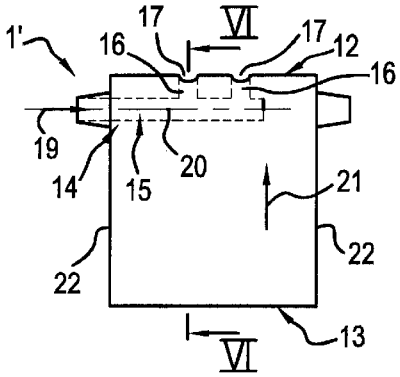
FIGS. 5–8 show views of second embodiment of an atomizer foil according to the invention.

The only outlet duct 16 shown in FIG. 1 is located at the center of the leading side edge 12, and the two outlet ducts 16 shown in FIG. 5 are located symmetrically about the center. With such a symmetrical location of the outlet ducts 16/the outlets 17 there is achieved an even distribution of liquid which is forced in through the inlet chamber in direction of arrow 19 and which after being forced out via the outlet 17 is distributed evenly over the two airfoil broad sides 11 of the atomizer foil and thereby the drops will get an even distribution in the cloud 10.

As it appears from the Figures, each of the airfoil broad sides 11 is located symmetrical about the median plane 18. Furthermore, it appears that each of the outlet ducts 17 extend perpendicularly to the longitudinal axis 20 through the boring forming the inlet chamber 15. Thereby the outlet ducts 16 extend in a direction in parallel with the longitudinal direction 21 of the atomizer foil. Also it appears that the leading and rear side edges 12,13 of the atomizer foil extend perpendicularly to the said longitudinal direction 21.

Figure 10:
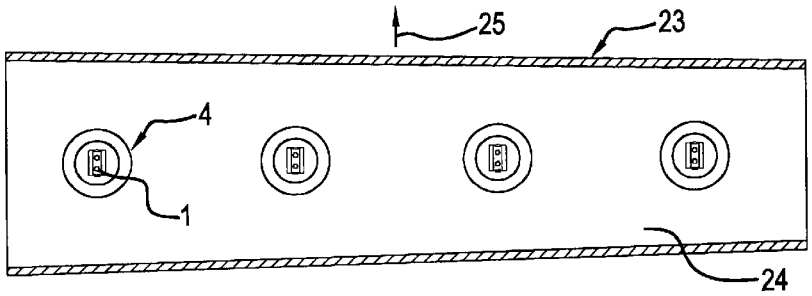
FIG. 10 shows a view, a partly sectional view, through a spray boom provided with atomizers/atomizer foils according to the invention.

FIG. 10 shows a partial view of a spray boom generally indicated by 23. The spray boom is intended for being placed on a spray plant where liquid is conveyed by means of ducts corresponding to the duct 6 in FIG. 9. Air is supplied through the hollow inner 24 of the spray boom 23. The spray boom is intended to be moved over the field in the direction of the arrow 25.

The single atomizers 4 are disposed so that atomizer foils are orientated so that their median plane 18 extends in parallel with the direction of movement 25. It has proved possible that hereby it is possible to achieve a very effective spreading and a very little coefficient of variation.

It has proved possible to orient the atomizer foils correctly and securely in the atomizer housing 3 when the longitudinal edges 22 of the atomizer foil are provided with guides 26 which will be explained more closely in the following and which cooperate with guide grooves 27 in the flow duct 2 of the atomizer.

Figure 11:
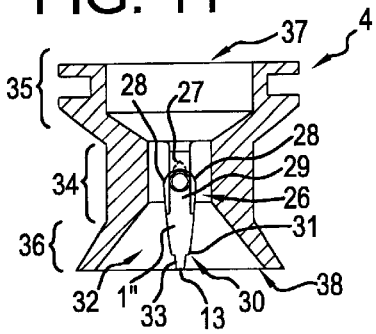
FIGS. 11–13 show mutually perpendicular sectional views, and a plane view of an atomizer containing a further embodiment of an atomizer foil according to the invention, respectively.
Figure 12:
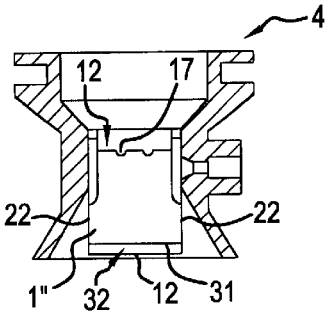
Figure 13:
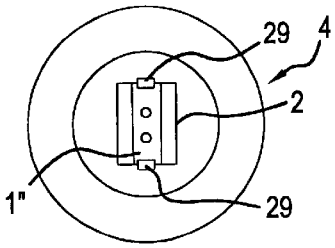

In FIGS. 11–13 there is illustrated a further embodiment of an atomizer of the kind which may be placed in the atomizer boom 23. The atomizer foil 1" differs by being provided with milled recesses 28 at each of the longitudinal edges 22 so that there is formed a projecting part 29 which may be received in the guide groove 27 in a close fit. The engagement between the guide 26 in the shape of the projecting part 29 and the guide groove 27 ensures that the atomizer foil 1" is orientated precisely relative to the atomizer housing with its longitudinal axis extending in parallel with a longitudinal section through the atomizer housing 3. Hereby there is ensured a uniform spreading with small coefficient of variation.

Furthermore, it has appeared to be advantageous to design the atomizer foil so that at the rear side edge 13 there is a stepwise reduction 30. The stepwise reduction 30 may be formed by removing a part of an airfoil profile which in principle is designed as illustrated in FIG. 3. Thus, the airfoil broad sides 11 may be finished with an edge 31. The rear part 32 of the atomizer foil will have a side edge 33 which mainly has the same course as the airfoil broad sides 11. The side edge 33 is placed closer to the median plane of the atomizer foil 1". Alternatively, the rear part 32 may have a mainly rectangular section.

Surprisingly, it appears in practice that by this design there is achieved a marked improvement in the distribution of the cloud 10 from the atomizer 3. It has not been possible for the inventor to give a causal explanation to this surprising improvement in the effect. It is assumed that the improvement is caused by a state of turbulence arising at the stepwise reduced part 30.

Likewise, it has appeared advantageous to provide the atomizer foil with a large thickness at the leading part as illustrated in FIGS. 11–22 instead of the relatively slender shape as illustrated in FIGS. 2–8. The atomizer foil is located in a flow duct 2 with a mainly rectangular section in a central part 34. The flow duct 2 comprises outer parts 35,36 at each side of the central part 34. In these outer parts 35,36 a dimensional change takes place to an approximately circular section at the entrance of the atomizer housing 37 and at the exit from the atomizer housing 38, respectively.

Figure 14:
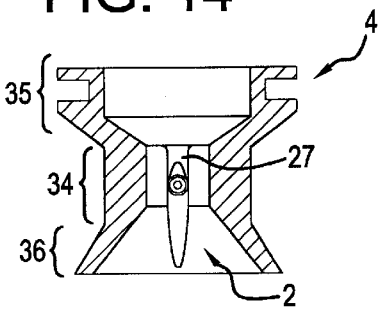
FIG. 14 shows a sectional view through a known atomizer housing with an atomizer foil according to FIGS. 1–4 or 5–8, FIGS. 15–16 show side views of the atomizer foil as illustrated in FIGS. 11–13, FIGS. 17–19 show side views of a further embodiment of an atomizer foil according to the invention.

An atomizer foil 1 or 1' as illustrated in FIG. 14 has a narrower cross section and fills up a lesser part of the width of the central part 34 of the atomizer duct. According to the invention, it is preferred to dimension the atomizer foil with a thickness so that it covers approximately half of the width in the rectangular central part 34 in the atomizer duct. Hereby there is achieved substantially improved distribution of the drops in the cloud 10. The surprisingly improved effect in the distribution of the drops in the cloud has not been possible to explain. However, it has appeared that a narrow wing as illustrated in FIG. 14 does not imply the same uniform distribution of drops by making the central part 34 more narrow and thereby achieve the same ratio between the thickest part of the atomizer foil and the width of the central part. Therefore, it is preferred to make the atomizer foils 1 and 1' with greater thickness than shown in FIGS. 1–8.

It has not been possible to set up a precise formula for the curvature of the airfoil broad sides 11. However, in practice it has appeared to be advantageous to design the atomizer foil 1 and the flow duct 2 so that the ratio between the free width of passage and the thickness of the atomizer foil multiplied with the width of the free through flow area has to be between 7 and 13. In this situation the free width of passage is expressed as the width of the central part of the flow duct minus the greatest thickness of the atomizer foil 1. In known examples, this factor will typically be 2–3 times as great.

In practice, it has appeared to be advantageous to have special ratios for atomizers/atomizer foils according to the invention which are made with size and form as indicated in the following table.

| | | Known | Atomizer foil 1" | Atomizer foil 1 |
|---|---|---|---|---|
| Length of central part 32 | L | 19 | 19 | 19 |
| Width of central part 32 | B | 14 | 14 | 10 |
| Thickest point on the atomizer foil | t | 4,2 | 6,8 | 3,5 |
| Radius of atomizer housing 3 | R | 19,5 | 19,5 | 19,5 |
| Ratio | | | | |
| (B − t)/B | 1 | 0,70 | 0,51 | 0,65 |
| (B − t) | 2 | 9,80 | 7,20 | 6,50 |
| (B − t)/t | 3 | 2,33 | 1,06 | 1,86 |
| L * (B − T)/(R ^ 2 * PI) | 4 | 0,16 | 0,11 | 0,10 |
| (B − t)/R | 5 | 0,50 | 0,37 | 0,33 |
| "= 2 * 3" | | 22,86667 | 7,623529 | 12,07143 |
| "= 1 * 4" | | 0,1097 | 0,0589 | 0,0672 |

Figure 15:
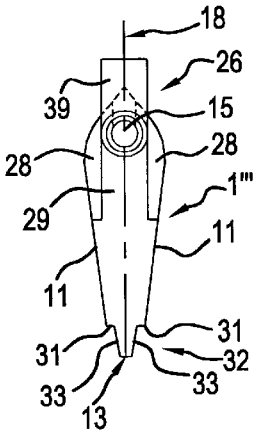
Figure 16:
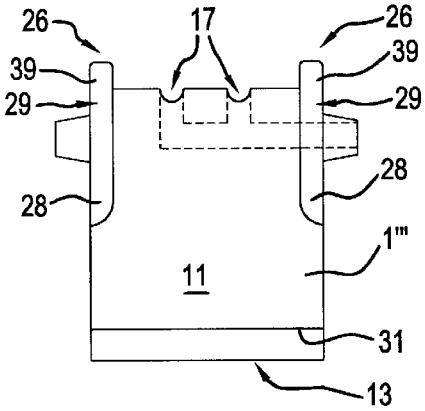
Figure 17:
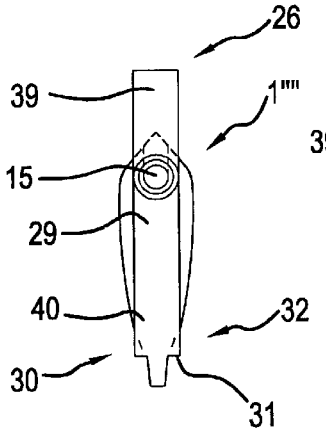
Figure 18:
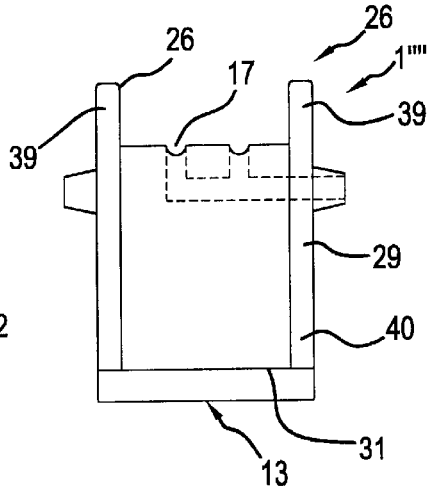
Figure 19:
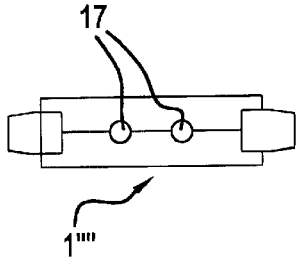
Figure 20:
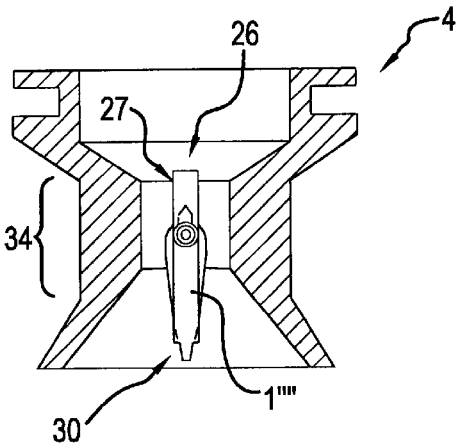
FIGS. 20–22 show mutually perpendicular sectional views, and a plane view, respectively, of an atomizer mounted with the atomizer foil shown in FIGS. 17–19.
Figure 21:
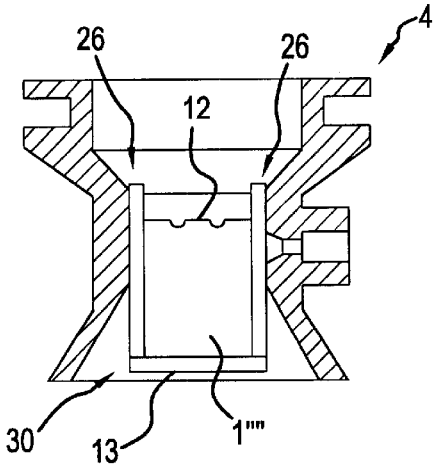
Figure 22:
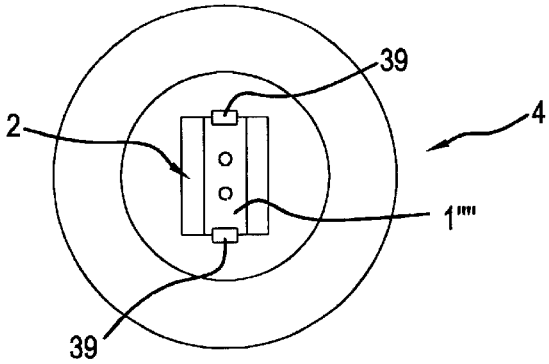

The same ratio indicated for the atomizer foil 1" will be true for the atomizer foil 1''' as shown in FIGS. 15 and 16 and for the atomizer foil 1"" as illustrated in FIGS. 17–22.

The atomizer foil 1''' differs from the previously described embodiments by the projecting part 29 comprising a forward pointing part 39 which is protruding above the leading side edge 12. Hereby there is achieved a more secure control of the orientation of the atomizer foil in the atomizer housing 3.

The atomizer foil 1"41 differs by the projecting part 29 likewise having a forward pointing part 39 extending forward of the leading side edge 12. Furthermore, the projecting part 29 has a backward pointing part 40 extending against the rear edge of the atomizer foil to a position at the step wise reduction 30. Hereby the control means 26 is further lengthened, and thus there is achieved an especially secure control of the orientation of the atomizer foil in the atomizer housing 3. As it appears from FIGS. 17 and 20, the broad sides 11 will extend within the backward pointing part 40 as indicated with dotted lines.

The shown atomizer foils are made from plastic by injection moulding.

EXAMPLES

Practical experiments are performed according to European norm with requirements according to ISO 5682/2. A test with an atomizer foil according to FIGS. 5–8 was performed under the following conditions:

An experiment was performed with a height of the boom of 90 cm over the measuring table. A variation in the air flow between 8 and 15 cm water column was applied. With a flow of 140 ml per minute, a coefficient of variation between 8,0 and 10,0 was achieved. This is a reduction by more than one half of the variation as compared to the known atomizer foils. Experiments with known atomizer foils have thus shown a variation between 25 and 35%.

Further tests were performed with boom heights between 60 and 90 cm and with the flow changed between 72 and 135 ml per minute. By these tests the air flow was kept constant at 11 cm water column. These experiments showed a coefficient of variation between 12 and 20. Thus, we are also here speaking about a substantially more uniform distribution of liquid than by corresponding experiments with known atomizers.

Furthermore, there has been performed practical experiments according to the same norm with an atomizer foil 1" according to FIGS. 11–13 which is placed in a boom 23 with an orientation as illustrated in FIG. 10.

Experiments with a boom height of 80 cm over the measurement table were performed. A variation in air flow between 10 and 25 cm water column was used. With a flow of 140 ml/minute, there was achieved a coefficient of variation between 4,0 and 7,3. This is thus a further improvement of the variation as compared to known atomizer foils. There was performed a corresponding measurement with a flow of 80 ml/minute, and hereby there was achieved a coefficient of variation between 5 and 9. This is likewise more than half the variation as compared to known atomizer foils.

Further tests were performed with further embodiments of the atomizer foil and with boom heights between 60 and 80 cm and with the flow changed between 80 and 140 ml/min. By these tests, the air flow has also varied between 10 and 25 cm water column. These experiments showed coefficient of variation between about 4 and about 11. This showed thus a substantially more uniform distribution of liquid in the cloud than known by the previously known atomizers, but also an improvement as compared to the coefficient of variation for the atomizers illustrated in FIGS. 5–8.

I claim:

1. An atomizer foil for atomizing a liquid in an air flow passing by the atomizer foil as this is located in a flow duct for the air flow, which atomizer foil is approximately shaped as an airfoil with two airfoil broad sides connected at a leading and a rear side edge as seen in the direction of air flow, and an inner duct intended for conveying the liquid at a leading part of the atomizer foil, characterised in that the inner duct comprises an inlet chamber connected with one or more outlet ducts, each extending in the longitudinal direction of the atomizer foil and having an outlet on the leading side edge so that the outlet or each outlet is disposed symmetrically in relation to a median plane through the width of the atomizer foil, and that the two airfoil broad sides are disposed symmetrically about said median plane.

2. The atomizer foil according to claim 1, characterised in that the outlet or each outlet is located symmetrically along the length of the leading side edge, and that the outlet or each outlet is symmetrical about a plane transverse to the atomizer foil.

3. The atomizer foil according to claim 1, characterised in that the inlet chamber is a mainly cylindrical boring extending from an inlet opening provided in the side wall of the atomizer foil, and which is connected with said one or more outlet ducts extending perpendicularly to a longitudinal axis of the boring, and which has a circular section smaller than the section of the inlet chamber.

4. The atomizer foil according to claim 3, characterised in that the diameter of each of the one or more outlet ducts is less than ¾ of the diameter of the inlet chamber, and preferably less than half of the said diameter, that each of the one or more outlet ducts has a length at least corresponding to the diameter of the inlet chamber and preferably at least two times said diameter, and that there is formed between 2 and 5 outlet ducts, preferably between 2 and 3.

5. The atomizer foil according to claim 1, characterised in that the two airfoil broad sides have a rectilinear course along their width at any point along their length.

6. The atomizer foil according to claim 1, characterised in that the atomizer foil has longitudinal edges provided with control means for cooperating with guide grooves in the flow duct.

7. The atomizer foil according to claim 1, characterised in that the leading and rear side edge extend in parallel with and perpendicularly to the longitudinal direction of the atomizer foil.

8. The atomizer foil according to claim 1, characterised in that a rear part of the atomizer foil is reduced in steps and that the rear side edge is a plane surface being perpendicular to the said median plane.

9. An atomizer for atomizing a liquid in an air flow passing by an atomizer foil as this is located in a flow duct for the air flow, which atomizer foil is approximately shaped as an airfoil with two airfoil broad sides connected at a leading and a rear side edge as seen in the direction of air flow, and an inner duct intended for conveying the liquid, and which has an outlet at a leading part of the atomizer foil, the flow duct having an angular or circular section, characterised in that the applied atomizer foil has been provided according to claim 1, and that the flow duct has a uniform section along a central part of its length.

10. The atomizer according to claim 9, characterised in that the atomizer foil at its longitudinal edges is provided with control means co-operating with control means in the wall of the flow duct.

11. A boom field sprayer comprising the atomizer according to claim 9 and a spray boom, wherein the atomizer is mounted in the spray boom with the atomizer foil orientated in parallel with a direction of movement of the boom field sprayer.

12. The boom field sprayer of claim 11, wherein the atomizer doses substances selected from the group consisting of pesticides, herbicides, fertilizers and combinations thereof.

13. A boom field sprayer comprising the atomizer foil according to claim l, an atomizer and a spray boom, wherein the atomizer foil is coupled to the atomizer and the atomizer is mounted in the spray boom with the atomizer foil orientated in parallel with a direction of movement of the boom field sprayer.

14. The boom field sprayer of claim 13, wherein the atomizer doses substances selected from the group consisting of pesticides, herbicides, fertilizers and combinations thereof.

* * * * *